US010858072B1

(12) United States Patent
Riordan et al.

(10) Patent No.: US 10,858,072 B1
(45) Date of Patent: Dec. 8, 2020

(54) ARTICULATED TOP ASSIST MECHANISM

(71) Applicant: Dowco, Inc., Manitowoc, WI (US)

(72) Inventors: Joseph Riordan, Black Diamond, WA (US); Jon Alexander, West Bend, WI (US); Robert Bartelsmeyer, Lebanon, MO (US); Bhavana Crossland, Lebanon, MO (US)

(73) Assignee: Dowco, Inc., Manitowoc, WI (US)

( * ) Notice: Subject to any disclaimer, the term of this patent is extended or adjusted under 35 U.S.C. 154(b) by 0 days.

(21) Appl. No.: 16/911,809

(22) Filed: Jun. 25, 2020

Related U.S. Application Data

(60) Provisional application No. 62/867,359, filed on Jun. 27, 2019.

(51) Int. Cl.
*B63B 17/02* (2006.01)

(52) U.S. Cl.
CPC ..... *B63B 17/02* (2013.01)

(58) Field of Classification Search
CPC ..... B60J 11/00; B63B 17/02
See application file for complete search history.

(56) References Cited

U.S. PATENT DOCUMENTS

| | | | |
|---|---|---|---|
| RE5,094 | E | 10/1872 | Mathewson |
| 646,347 | A | 3/1900 | Betty |
| 1,039,986 | A | 10/1912 | Merritt |
| 1,289,265 | A | 12/1918 | Francois et al. |
| 1,473,436 | A | 11/1923 | Leopold |
| 1,541,674 | A | 6/1925 | Wever |
| 1,639,009 | A | 8/1927 | Singley |
| 1,972,246 | A | 9/1934 | Sauer |
| 2,145,307 | A | 1/1939 | Hunt |
| 2,210,147 | A | 8/1940 | Griffith |
| 2,817,345 | A | 12/1957 | Woodruff, Sr. |
| 2,818,291 | A | 12/1957 | Corns |
| 2,895,757 | A | 7/1959 | Kaspar |
| 3,187,373 | A | 6/1965 | Fisher |
| 3,316,012 | A | 4/1967 | Thier |
| 3,354,892 | A | 11/1967 | Frieder |

(Continued)

FOREIGN PATENT DOCUMENTS

| | | |
|---|---|---|
| DE | 202005009471 | 10/2005 |
| EP | 2727494 | 5/2014 |

(Continued)

OTHER PUBLICATIONS

"Delrin® Acetal Resin." DuPont, https://web.archive.org/web/*/http://www.dupont.com/products-and-services/plastics-polymers-resins/thermoplastics/brands/delrin-acetal-resin.html. Internet Archive dated Jul. 29, 2013.

(Continued)

*Primary Examiner* — Stephen P Avila
(74) *Attorney, Agent, or Firm* — Shane Delsman; Godfrey & Kahn, S.C.

(57) ABSTRACT

A frame for a top of a boat that can be moved between a deployed position and a collapsed position with the aid of an articulated top assist mechanism such that the manual effort required to move the top between the collapsed position and deployed position is minimized or eliminated. The articulated top assist mechanism has a torque hub attached to a frame element of the top and a spring that applies torque to the hub by a strap attached to the hub and the spring.

30 Claims, 15 Drawing Sheets

(56) References Cited

U.S. PATENT DOCUMENTS 3,399,687 A 9/1968 Frieder
3,489,452 A 1/1970 Plante
3,525,448 A 8/1970 Bauer
3,613,151 A 10/1971 Anderson et al.
3,653,079 A 4/1972 Bourgraf et al.
3,801,208 A 4/1974 Bourgraf et al.
3,930,645 A 1/1976 Anderson
3,955,240 A 5/1976 Schuh et al.
3,955,732 A 5/1976 Boschen
4,106,145 A 8/1978 Gillen et al.
4,111,217 A 9/1978 Victor
4,139,245 A 2/1979 McCloskey
4,356,593 A 11/1982 Heininger et al.
4,577,986 A 3/1986 Wang
4,660,791 A 4/1987 Lisak
4,683,900 A 8/1987 Carmichael
4,804,220 A 2/1989 Rosheim
4,928,916 A 5/1990 Molloy
5,058,239 A 10/1991 Lee
5,058,829 A 10/1991 Bentley
5,251,359 A 10/1993 Finkl
5,271,423 A 12/1993 Eychaner
5,303,667 A 4/1994 Zirkelbach et al.
5,353,892 A 10/1994 Lu
5,380,113 A 1/1995 Boehm
5,413,063 A 5/1995 King
5,440,948 A 8/1995 Cheng
5,441,066 A 8/1995 Harris
5,457,828 A 10/1995 Huang
5,472,301 A 12/1995 Wallen
5,520,139 A 5/1996 King et al.
5,539,957 A 7/1996 Schmidt
5,577,415 A 11/1996 Reasoner
5,611,552 A 3/1997 Miles et al.
5,645,309 A 7/1997 Graf
5,681,045 A 10/1997 Liao
5,685,660 A 11/1997 Liao
5,697,320 A 12/1997 Murray
5,706,752 A 1/1998 Menne, Jr. et al.
5,730,449 A 3/1998 Miles
5,730,542 A * 3/1998 Cheng ..... A47D 13/063 16/321
5,740,998 A 4/1998 Lindsay et al.
5,766,081 A 6/1998 Desmarais
5,803,104 A 9/1998 Pollen
5,938,223 A 8/1999 Kotlier
5,941,011 A 8/1999 Baker
6,018,846 A 2/2000 Huang
6,042,066 A 3/2000 Maharg et al.
6,082,753 A 7/2000 Kotlier
6,135,487 A 10/2000 Flannery et al.
6,135,668 A 10/2000 Lin
6,151,756 A 11/2000 Czipri
6,152,434 A 11/2000 Gluck
D437,210 S 2/2001 Borotto et al.
6,209,477 B1 4/2001 Biedenweg
6,223,366 B1 5/2001 Cheng
6,223,680 B1 5/2001 Frink et al.
6,238,125 B1 5/2001 Lin
6,257,261 B1 7/2001 Johnson
D451,364 S 12/2001 Borotto et al.
D451,371 S 12/2001 Borotto et al.
6,353,969 B1 3/2002 Lemole
6,354,758 B1 3/2002 Chaulk
6,393,664 B1 5/2002 Habegger et al.
6,467,986 B2 10/2002 Feng
6,533,489 B1 3/2003 Zheng
6,536,726 B1 3/2003 Tull
6,565,069 B2 5/2003 Morris
6,594,860 B2 7/2003 Czipri
6,666,163 B2 12/2003 Pastor et al.
6,672,241 B2 1/2004 Warfel et al.
6,676,329 B2 1/2004 Mandon et al.
6,711,783 B2 3/2004 Lemole
6,722,812 B1 4/2004 Carletti et al.
6,763,650 B1 7/2004 Snow
6,851,652 B1 2/2005 Huang
6,907,642 B1 6/2005 Czipri
6,928,766 B1 8/2005 Goebel et al.
6,944,913 B2 9/2005 Henderson et al.
6,964,425 B2 11/2005 Turner
6,968,800 B1 11/2005 Becht
6,983,716 B1 * 1/2006 Ankney ..... B63B 17/02 114/361
7,003,849 B2 2/2006 Cohen et al.
7,007,344 B2 3/2006 Lee
7,029,197 B2 4/2006 Lin et al.
7,063,035 B2 6/2006 Belcher
7,077,906 B2 7/2006 Colombo et al.
7,100,739 B2 9/2006 Parker et al.
7,131,166 B2 11/2006 Cohen et al.
7,159,530 B1 1/2007 Shearer et al.
7,162,968 B2 1/2007 Thompson
7,204,466 B2 4/2007 Hsieh
7,210,726 B2 5/2007 Merlot, Jr. et al.
7,210,871 B2 5/2007 Slatter
7,254,869 B2 8/2007 You
7,290,472 B2 11/2007 Gass et al.
7,302,907 B2 12/2007 Carlton
7,309,054 B2 12/2007 Slatter et al.
7,325,856 B2 2/2008 Merlot, Jr. et al.
7,331,304 B2 2/2008 Erskine et al.
7,334,956 B2 2/2008 Taylor
7,340,801 B2 3/2008 Yamaguchi
7,380,311 B2 6/2008 Chen
7,389,737 B1 * 6/2008 Schwindaman ..... B63B 17/02 114/361
7,413,370 B2 8/2008 Burnley
7,438,015 B1 10/2008 Schwindaman
7,458,333 B2 12/2008 Yang
7,461,995 B2 12/2008 Burnley
7,481,438 B2 1/2009 Hernandez
7,490,574 B2 2/2009 Shearer et al.
7,523,906 B2 4/2009 Bennett
7,536,971 B1 5/2009 Fry
7,571,691 B2 8/2009 Russikoff
7,614,097 B1 11/2009 Cheng
7,634,969 B2 12/2009 Neunzert et al.
7,661,747 B2 2/2010 Erskine et al.
7,674,063 B2 3/2010 Jan et al.
7,721,391 B2 5/2010 Bukovitz et al.
7,726,618 B2 6/2010 Pedemonte
7,735,431 B2 6/2010 Neunzert et al.
7,753,612 B2 7/2010 Bouru et al.
7,774,901 B1 8/2010 Huang
7,895,964 B2 3/2011 Russikoff
7,921,513 B2 4/2011 Burnley
7,921,797 B2 4/2011 James
7,950,342 B2 5/2011 Russikoff
7,984,531 B2 7/2011 Moore
8,006,345 B1 8/2011 Bryce
8,007,196 B2 8/2011 Whitling et al.
8,052,110 B2 11/2011 Wang
8,069,533 B2 12/2011 Yu et al.
8,087,374 B2 1/2012 Porter
8,152,118 B2 4/2012 Melic
8,297,208 B2 10/2012 Hoffman
8,359,709 B2 1/2013 Van Gennep
8,425,345 B2 4/2013 Wall, Jr. et al.
8,590,849 B2 11/2013 Melic
8,616,511 B2 12/2013 James
8,635,743 B2 1/2014 Smith et al.
8,708,100 B2 4/2014 Schwoerer
8,752,498 B1 6/2014 Schwindaman et al.
8,766,646 B2 7/2014 Li et al.
8,857,366 B2 10/2014 Russikoff
8,967,710 B2 3/2015 Hu et al.
8,973,866 B2 3/2015 Ribarov et al.
8,973,899 B2 3/2015 Buckingham
9,016,773 B2 4/2015 Tanner et al.
9,032,983 B2 5/2015 Jin
9,085,914 B1 * 7/2015 Kulm ..... A01M 31/025
9,096,291 B2 8/2015 Perosino et al.
9,139,258 B2 9/2015 Russikoff

(56) References Cited

U.S. PATENT DOCUMENTS

| | | | |
|---|---|---|---|
| 9,169,680 | B2 | 10/2015 | Kim et al. |
| 9,365,264 | B2 | 6/2016 | Perosino et al. |
| 9,371,108 | B2 | 6/2016 | Bettin |
| 9,488,216 | B2 | 11/2016 | Godiot et al. |
| 9,580,149 | B2 | 2/2017 | Poppell et al. |
| 9,604,702 | B2 | 3/2017 | Hough et al. |
| 9,752,364 | B2 | 9/2017 | James |
| 9,783,266 | B2 | 10/2017 | Hough |
| 9,783,267 | B1 | 10/2017 | Alexander et al. |
| 9,815,525 | B2 | 11/2017 | Hough |
| 9,849,939 | B2 | 12/2017 | Hough et al. |
| 9,909,617 | B1 | 3/2018 | Prey |
| 10,167,894 | B2 | 1/2019 | James |
| 10,513,314 | B2 | 12/2019 | Parniske et al. |
| 2004/0036222 | A1 | 2/2004 | Chou |
| 2006/0016047 | A1 | 1/2006 | Blackman et al. |
| 2007/0287614 | A1 | 12/2007 | Fuller |
| 2008/0066794 | A1 | 3/2008 | Durfee |
| 2008/0193205 | A1 | 8/2008 | Peng et al. |
| 2009/0057505 | A1 | 3/2009 | Chen |
| 2009/0119877 | A1 | 5/2009 | Garrett |
| 2011/0272923 | A1 | 11/2011 | Chen |
| 2015/0291259 | A1 | 10/2015 | Perosino et al. |

FOREIGN PATENT DOCUMENTS

| | | |
|---|---|---|
| JP | 06090605 | 4/1994 |
| WO | 2008010909 | 1/2008 |

OTHER PUBLICATIONS

Hinge; Dowco, Inc.; prior art for purposes of prosecution.

Peloton Precision Bicycle Products Hitch Perfect : Kuat NV product information; 2014 Move Press LLC.

Website screenshot of Dowco Marine Inc.; http://www.dowcomarine.com/; obtained from the Internet Archive Jun. 23, 2015.

Website screenshot of Dowco Replacement Aft Top Canopy; Prior art for purposes of prosecution.

Website screenshot of PWR-ARM Automatic Bimini Top; https://pwr-arm.com; obtained from the Internet Archive Jun. 15, 2013.

Website screenshot of YouTube; PWR-ARM II, by Schwintek Inc.; published on Oct. 19, 2011.

Bimini Top Retraction System (Schwintek, Inc.) as illustrated in Fig. 1 of U.S. Pat. No. 7,921,797, known to be on sale or publicly available before Mar. 14, 2007.

* cited by examiner

ARTICULATED TOP ASSIST MECHANISM

CROSS REFERENCE TO RELATED APPLICATION

This application claims the benefit of and priority to U.S. Provisional Patent Application Ser. No. 62/867,359, filed Jun. 27, 2019, the disclosure of which is hereby incorporated by reference herein in its entirety for all purposes.

FIELD OF THE INVENTION

The present invention relates generally to the field of watercrafts. More specifically, the present invention relates to assist mechanisms for articulating tops.

BACKGROUND

Boats can be equipped with some form of sun shade apparatus or other enclosure such as a top, canopy or bimini. Some tops can be moved between an extended, engaged, locked or radar position and a stowed, collapsed, unlocked or trailering position. Some tops are constructed out of tubular frames that articulate to at least two positions. Some such tops can be manually articulated to a desired position, while others utilize mechanical aids such as hydraulics or electric motors to power the apparatus into the desired position(s).

The manual articulation of tops often requires a significant effort to move the top into the desired position(s). One common method for manually articulating a top is to manually lift the top into the desired state, such as an extended position. Then, the top can be secured in position by latching or locking a frame member, such as a bow, arm or strut, such as to hardware that is attached to the watercraft. Such manual articulation requires significant strength to raise the top into position, and dexterity and balance to secure the top in position. Such manual articulation can be unsafe if undertaken by a single person.

Some tops have been designed such that they use gravity to pull the top into the stowed position when released from the extended position. However, when released, such tops violently collapse, which can injure someone in the path of the top, damage the top and/or the watercraft or be noisy, potentially scaring away wildlife. Other tops may use powered mechanical systems to decrease or even eliminate the need for manual articulation. However, such powered tops are often cost prohibitive and may not be useable with all boat models, as such powered tops can require specific structural elements for mounting thereto and power.

Therefore, there is need for a cost-effective top that decreases the effort required to manually articulate the top. There is also a need for a top that can be manually articulated without the risk of a sudden collapsing of the top and/or that can be locked, such as in the collapsed and deployed positions.

It will be understood by those skilled in the art that one or more aspects of this invention can meet certain objectives, while one or more other aspects can lead to certain other objectives. Other objects, features, benefits and advantages of the present invention will be apparent in this summary and descriptions of the disclosed embodiment, and will be readily apparent to those skilled in the art. Such objects, features, benefits and advantages will be apparent from the above as taken in conjunction with the accompanying figures and all reasonable inferences to be drawn therefrom.

BRIEF DESCRIPTION OF THE DRAWINGS

The accompanying drawing figures, which are incorporated in and constitute a part of the description, illustrate several aspects of an articulated top assist mechanism, and together with the description, serve to explain the principles of the articulated top assist mechanism. The following description is based on embodiments of the articulated top assist mechanism and should not be taken as limiting the articulated top assist mechanism with regard to alternative embodiments that are not explicitly described herein. A brief description of the figures is as follows.

Figure 1:
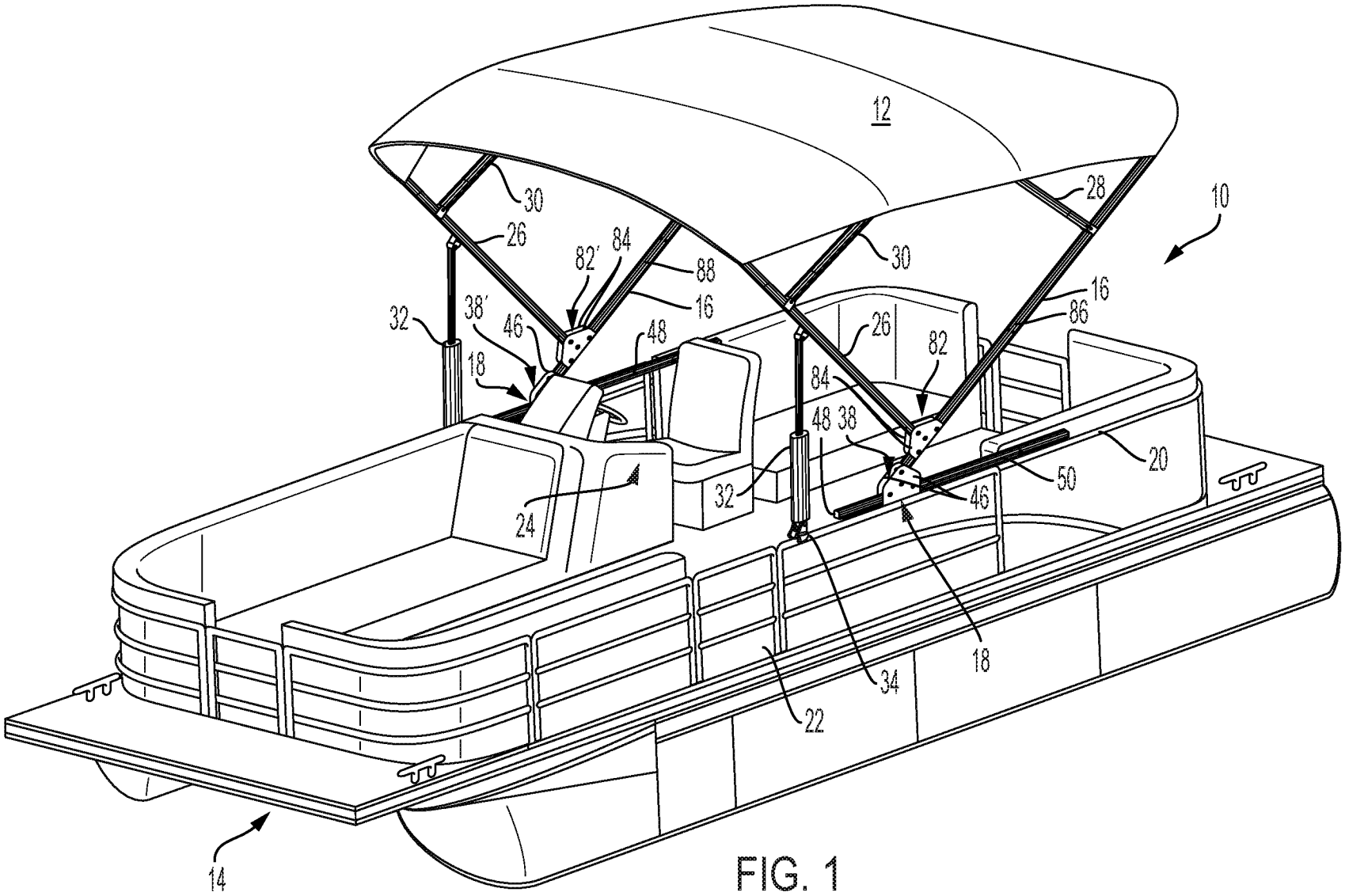
FIG. 1 is a front perspective view of a vehicle with an articulated top having an assist mechanism.

In view of the many possible embodiments to which the principles of an articulated top assist mechanism may be applied, it should be recognized that the embodiments described herein with respect to the drawing figures are meant to be illustrative only and should not be taken as limiting the scope of the invention.

DETAILED DESCRIPTION

Figure 6:
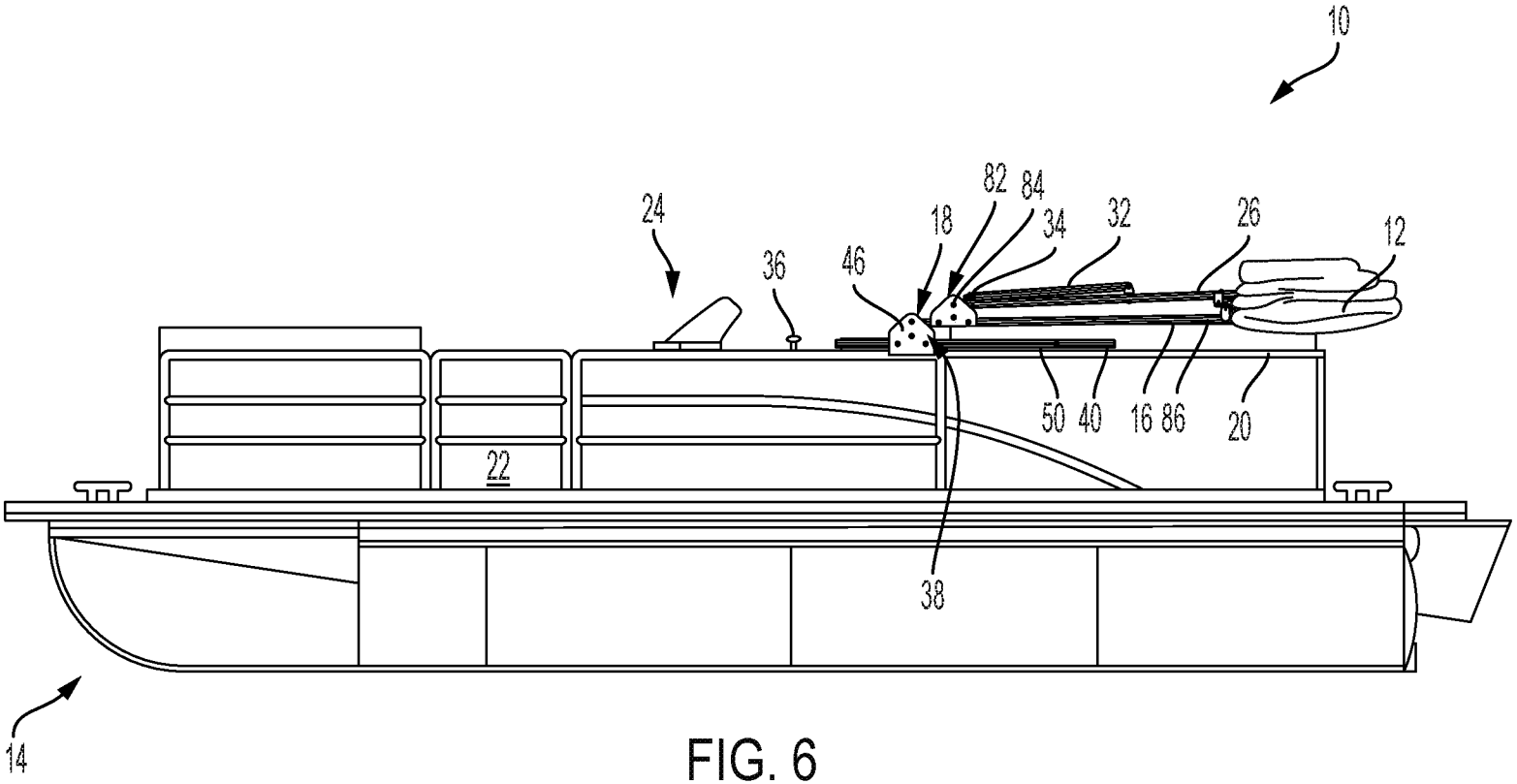
FIG. 6 is an elevation view of the vehicle with the articulated top of FIG. 2 in the stowed position.
Figure 7:
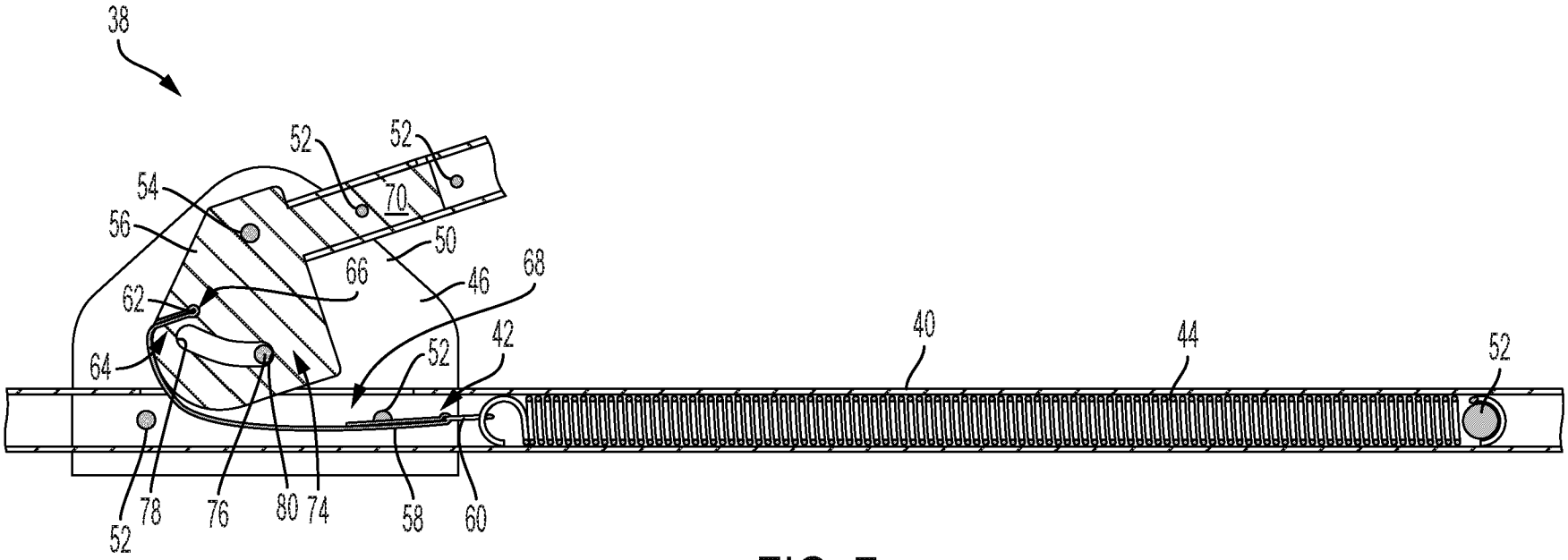
FIG. 7 is an enlarged cross-sectional elevation view of the assist mechanism of FIG. 4 when the articulated top is in the stowed position.
Figure 8:
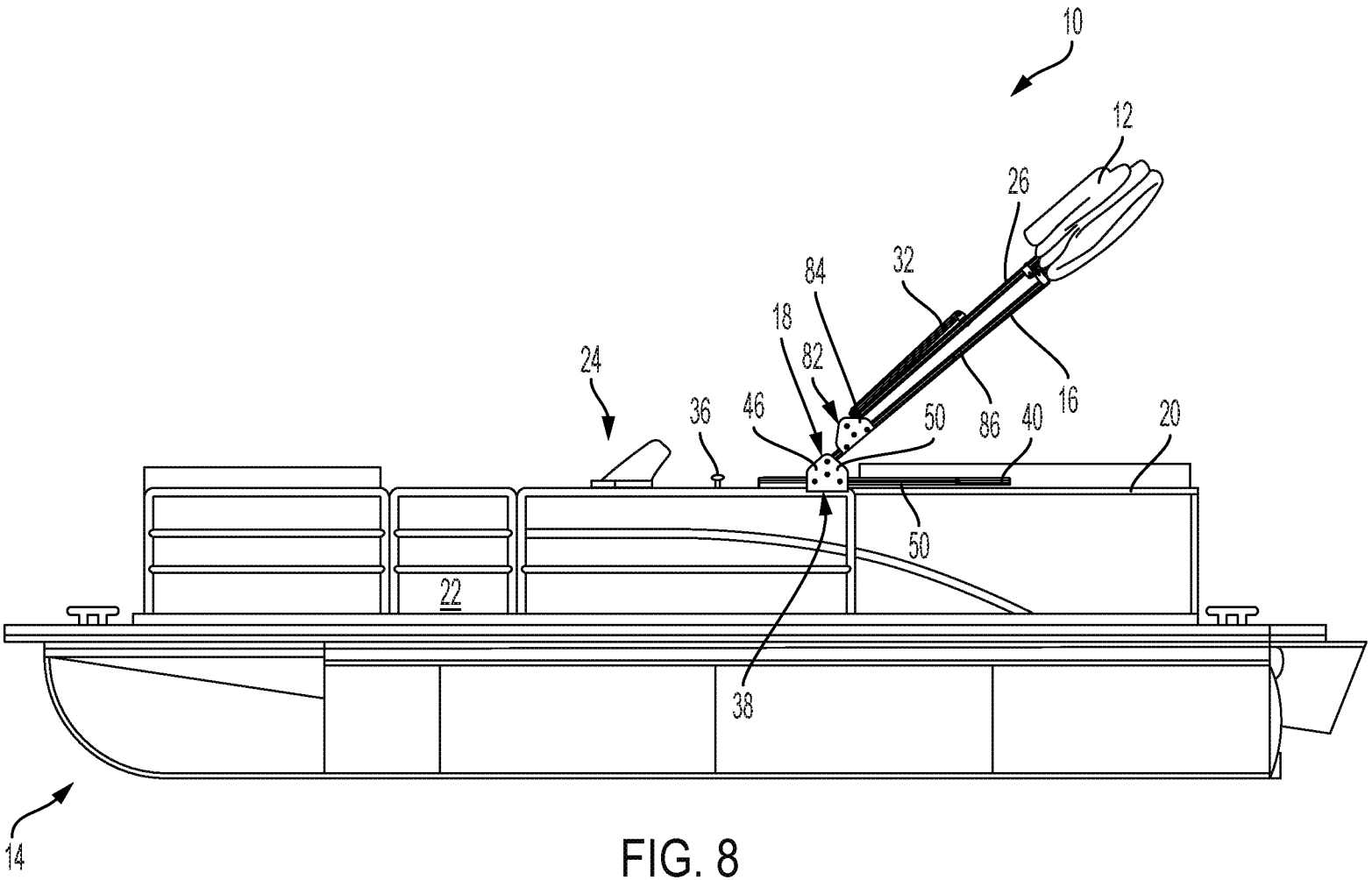
FIG. 8 is an elevation view of the vehicle with the articulated top of FIG. 2 in the radar position.
Figure 9:
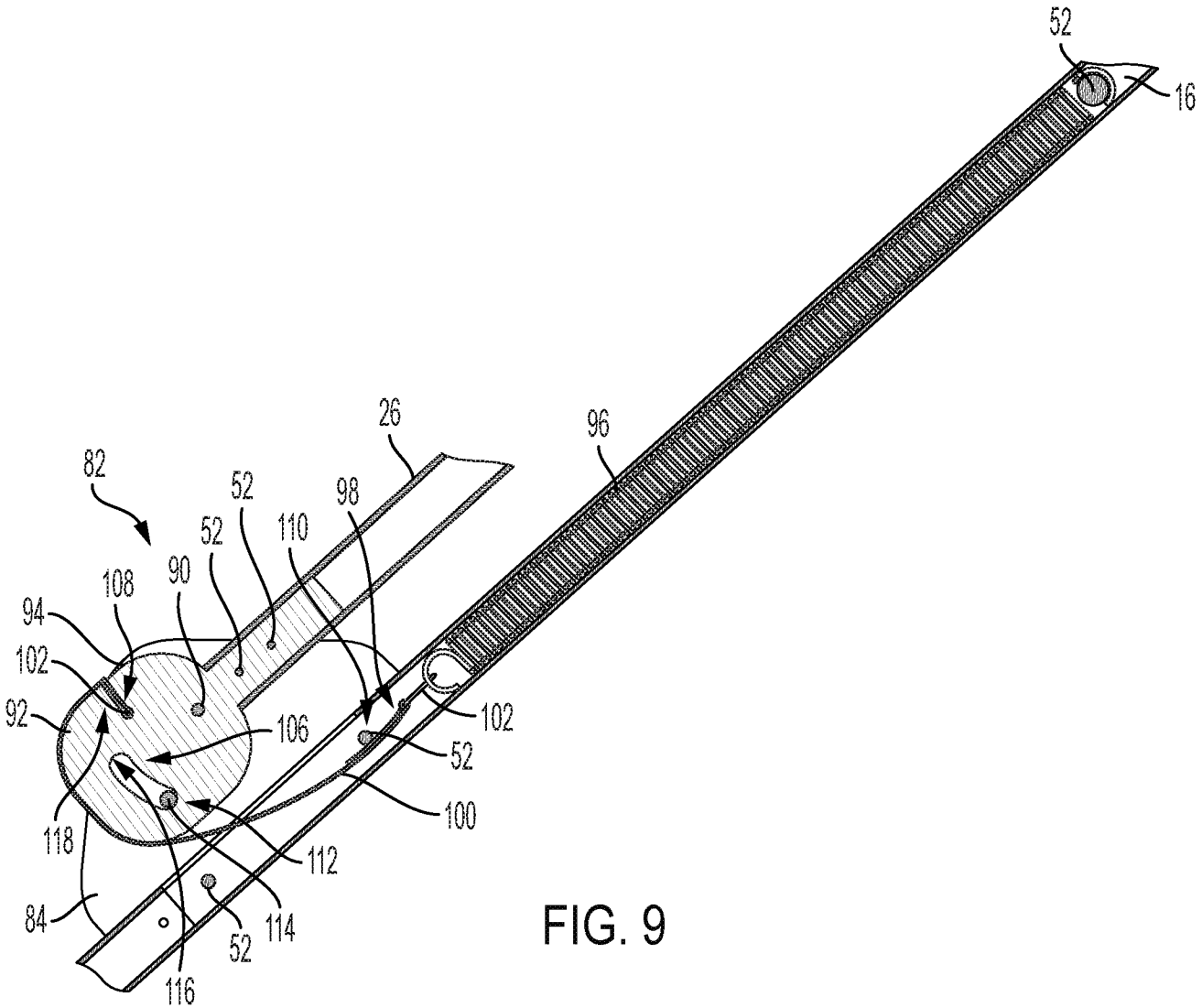
FIG. 9 is an enlarged cross-sectional elevation view of the assist mechanism of FIG. 5 when the articulated top is in the radar position.
Figure 10:
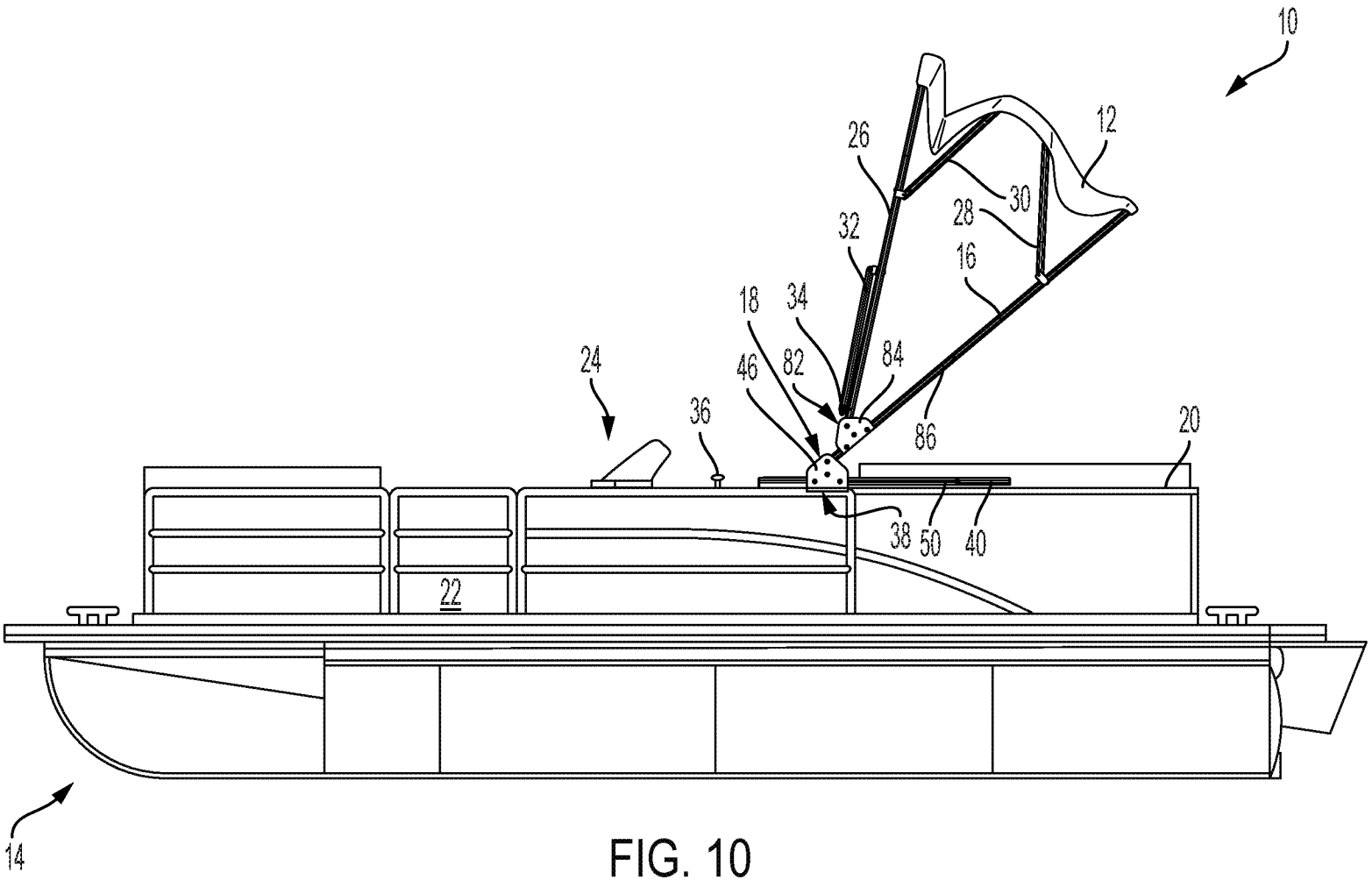
FIG. 10 is an elevation view of the vehicle with the articulated top of FIG. 2 in the partially deployed position.

As seen in FIGS. 1-3, 6, 8 and 10, a frame for a structure referred to as a marine top, canopy or bimini 10 is shown. The frame of the top 10 shown in FIG. 1 is generally comprised of frame members that support a cover, cover material or covering 12, which can be made from canvas or other suitable material, for providing shade or sheltering from the elements, such as to a vehicle 14. In one embodiment, the top 10 is configured to be moved between a stowed or trailering position (as seen in FIG. 6), for use when the vehicle 14 to which it is attached is being transported such as on a trailer or when stored, and a deployed position (as seen in FIG. 1), for use when shade or shelter from the elements is desired. The top 10 may also be moved to a radar position (as seen in FIG. 8), which is between the stowed position and deployed position, for use when the vehicle is in use, but the top is not needed for shelter or if only a small amount of shelter from the elements is desired.

The top 10 embodiment seen in FIG. 1 includes a main frame member, main bow or aft bow 16 that is pivotally connected or attached to a mounting bracket or mount 18. The mounting bracket 18 provides pivotal or rotatable connection between the frame members and the vehicle 14 such that the frame can be moved between a stowed or trailering position and a deployed position. The mounting bracket 18 attaches the frame to the vehicle 14, such as to a wall or rail 20 of the vehicle. While the embodiment shown is of a pontoon-style boat, it is understood by those skilled in the art that the top could be used in a similar fashion on other vehicles, including but not limited to, sport boats, V-hull boats, flat bottom boats, other various marine vehicles, ATVs, UTVs, etc.

The mounting bracket 18 (and/or the railing 20 or mounting surface) is configured to disperse the forces, for example from raising and lowering or from wind when the frame is deployed, along a greater area of the rail 20 of the vehicle 14 as compared to attaching the individual frame members directly to the rail of the vehicle subjecting the rail to greater point loads. The mounting bracket 18 shown in FIG. 2 also avoids inconveniencing or interfering with the gate 22 or the captain's seat or the throttle, controls, windscreen and/or aftermarket accessories often located in the captain's area 24.

The frame includes a secondary frame member, secondary bow or forward bow 26. In the embodiment seen in FIG. 1, the secondary frame member 26 is pivotally or rotatably attached to the aft bow 16. Alternatively, the secondary frame member 26 could be attached to the mounting bracket 18 as seen in FIGS. 11-15.

Figure 2:
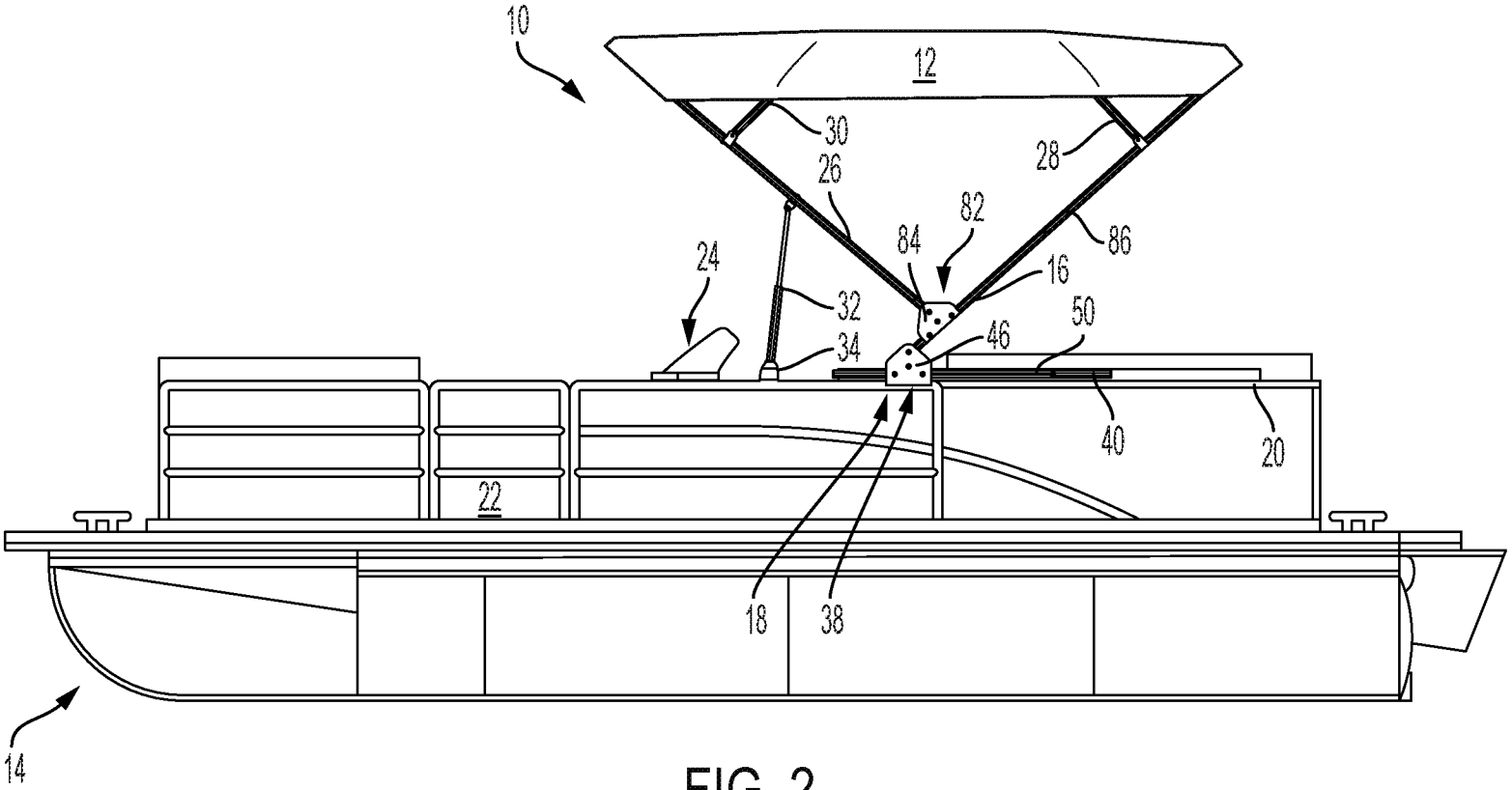
FIG. 2 is a side elevation view of a vehicle with an articulated top having an assist mechanism.
Figure 3:
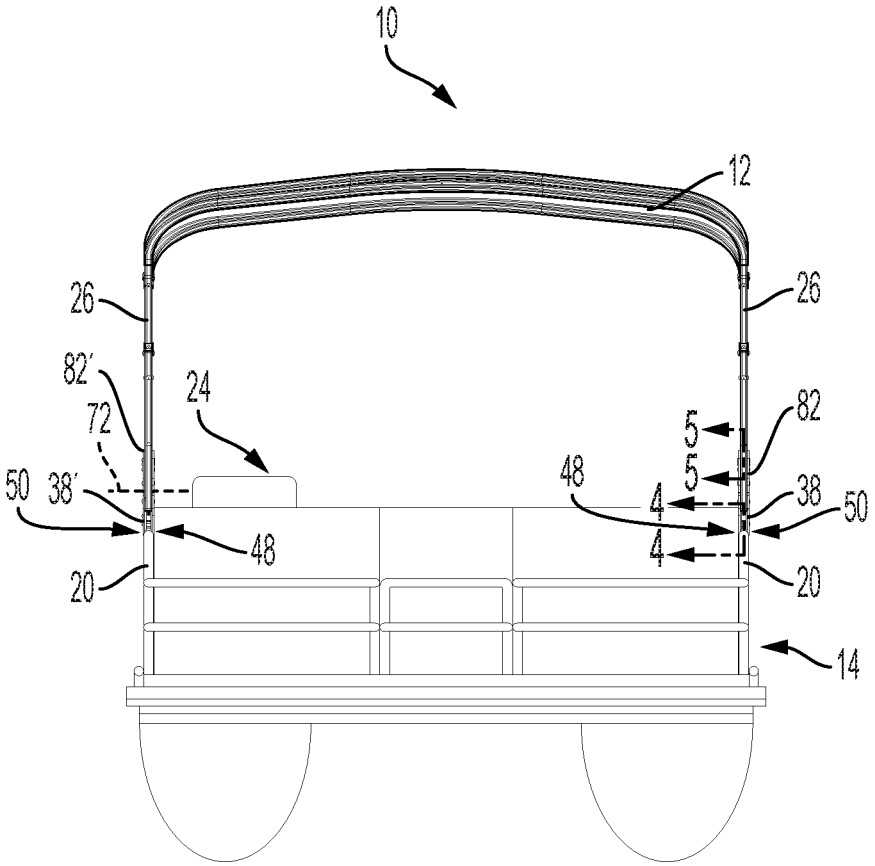
FIG. 3 is a front elevation view of the vehicle with an articulated top having an assist mechanism of FIG. 2.

In the embodiment seen in FIG. 6, when the top 10 is in the stowed position, the main frame member 16 is in the first position, the secondary frame member 26 is in the first or closed position and the main frame member is generally parallel to the secondary frame member. When the top 10 is in the radar position, as seen in FIG. 8, the main frame member 16 is in the second position, the secondary frame member 26 is in the closed position and the main frame member is generally parallel to the secondary frame member. When the top 10 is in the deployed position, as seen in FIG. 2, the main frame member 16 is in the second position, the secondary frame member 26 is in the open position and the main frame member is generally perpendicular to the secondary frame member.

The main frame member 16 and the secondary frame member 26 are also attached to the covering 12 such that as the frame members are moved to the deployed position, for example the portion of the secondary frame member that is attached to the covering is moved away or remote from the portion of the main frame member attached to the covering, the covering will be expanded or unfolded. As the frame members 16, 26 are moved to the stowed position, the covering 12 will be folded or contracted. In one embodiment, the frame members 16, 26 are attached to the covering 12 by extending through sleeves formed in the underside of the covering. However, other means of attaching frame members to a covering are known in the industry, for example, the use of straps, snaps, fasteners, etc., the use of which would not defeat the spirit of the invention.

In the embodiment seen in FIG. 1, the main frame member 16 and the secondary frame member 26 are attached to and support the covering 12 at the rear and front of the covering. One or more auxiliary bows can be connected to the main and/or secondary frame member 16, 26. In the embodiment seen in FIG. 1, a first auxiliary bow 28 is attached to the main frame member 16 and a second auxiliary bow 30 is attached to the secondary frame member 26 to provide additional support to the covering 12. The auxiliary bows 28, 30 could also be attached to the covering 12 as described above with respect to the main and secondary frame members 16, 26. The auxiliary bows 28, 30 can be pivotally or rotatably attached to the main frame member 16 and secondary frame member 26 respectively such that as the main frame member 16 and the secondary frame member 26 are moved to the deployed position, the covering 12 will expand and in some embodiments, be pulled taught therebetween. Because the auxiliary bows 28, 30 are connected to the covering 12, as the covering expands, the covering will cause the auxiliary bows to be rotated to their deployed position wherein the portion of the auxiliary bows attached to the covering will be remote from the portion of the main frame member 16 and secondary frame member 26 respectively are attached to the covering.

The top 10 may also include one or more struts 32 to secure the top in the deployed position and/or the stowed position. In one embodiment seen in FIG. 1, the strut 32 is rotatably attached to the secondary frame member 26 at one end and has a fastener or latch 34 at its second end. After the top 10 is moved from its collapsed or stowed position into the deployed position, the strut 32 can be attached to the vehicle such as by using the latch 34 on a button 36 attached to the rail 20. The strut 32 could have a ratcheting feature such that once it is attached to the vehicle, the top 10 can be pulled down at the front to further secure the top as disclosed for example, in U.S. Pat. Nos. 9,849,939, 9,815,525, 9,783,266, and 9,604,702, owned by the owner of the present application, and which are hereby incorporated herein for all purposes.

Figure 4:
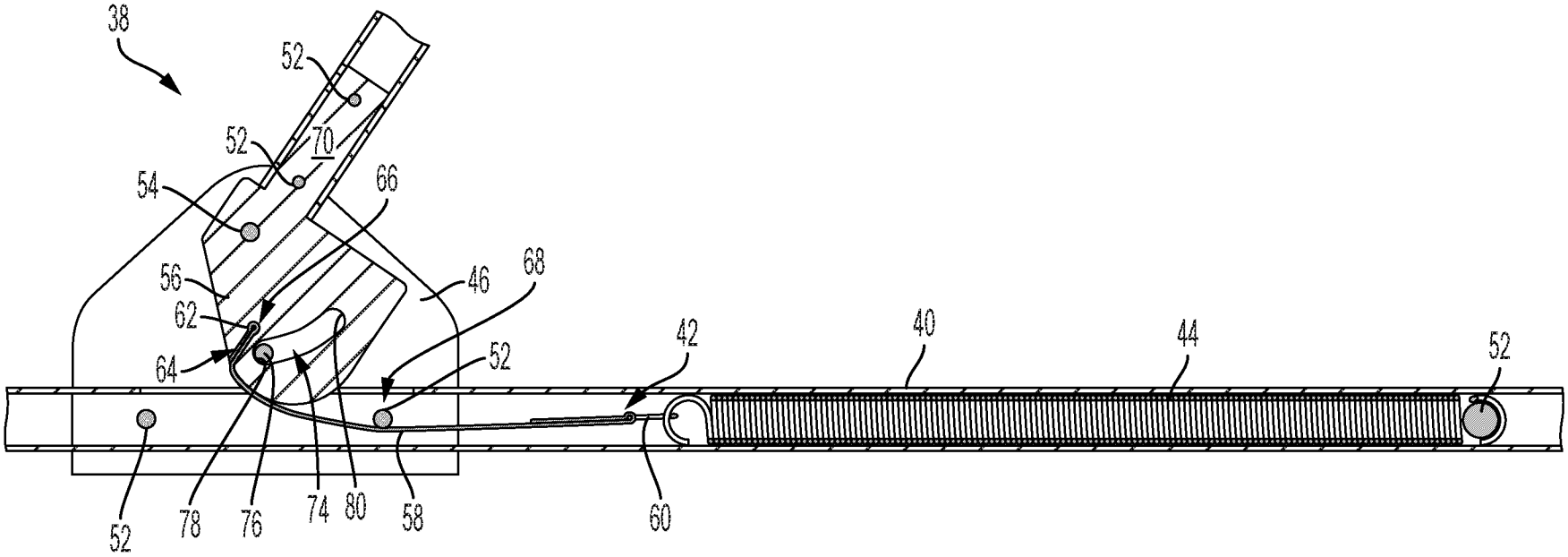
FIG. 4 is an enlarged cross-sectional elevation view of the assist mechanism of FIG. 1 when the articulated top is in the deployed position, according to one embodiment of the present disclosure.

In the embodiment seen in FIG. 1, the frame is attached to an assist mechanism 38 that helps assist the top 10 into the radar and deployed positions. In one embodiment the assist mechanism is the mounting bracket 18, configured to attach the top 10 to the vehicle 14, such as by bolts through a housing or body 40 and into the a 20. The housing illustrated in FIG. 4 is a square tubular housing forming an interior cavity 42. The interior cavity 42 includes a biasing member 44. In the embodiment seen in FIG. 4, the biasing member 44 is a tension coil spring, however, other biasing members are known in the art, including, but not limited to other spring types (e.g. spiral spring, torsion spring), pistons, dampers, elastic, or resilient members, etc., the use of which would not defeat the spirit of the invention. The biasing member 44 is held at a first end in the interior cavity 42 of the housing 40 by a nut and bolt 52 such as to create a fixed end. Locating the biasing element at least partially in the interior cavity 42 allows it to be hidden, for a more pleasing appearance. The biasing member 44 could be hidden in other structures, for example the rail 20, or not without defeating the spirit of the invention.

In one embodiment a pair of side plates 46 are attached to the interior side 48 and exterior side 50 of the housing 40.

The side plates 46 are attached to the housing 40 by nuts and bolts 52 in the embodiment illustrated in FIG. 4, but other means are known for connecting side plates and a housing, including, but not limited to other fasteners, welding, integrally forming, threading, adhering, friction fitting, etc., the use of which would not defeat the spirit of the invention.

Above the housing 40, an axle 54 extends between the pair of side plates 46. The axle 54 is a nut and bolt in the embodiment illustrated in FIG. 4, but other means are known for creating an axle, including, but not limited to other fasteners, a rod, integrally forming, slots, etc., the use of which would not defeat the spirit of the invention.

The axle 54 extends through a lobe or core 56 located between the pair of side plates 46. In one embodiment, the lobe 56 is attached off-center. However, the axle 54 could also be centrally located as seen in the embodiment seen in FIG. 12. In FIG. 4, the lobe 56 is connected to a second end of the biasing member 44 such that the lobe (and, thereby, the main frame member 16) is urged to rotate, in this example, towards the front of the vehicle and the top 10 to the radar or deployed position.

In one embodiment, the second end of the biasing member is connected to a strap 58. For example, the end of the strap 58 could extend through a ring 60, overlap and be sown on itself so as to secure the ring to the strap. The second end of the biasing member 44 could be a hooked end that extends through the ring 60. However, other means are known for attaching a strap to a biasing member, including, but not limited to creating a hole in the strap, sowing the strap directly onto the biasing member, adhering, fasteners, hooks and loops, etc., the use of which would not defeat the spirit of the invention.

The second end of the strap 58 could also be overlapped onto itself and sown to create a loop to hold a pin 62. In the embodiment seen in FIG. 4, the lobe 56 includes a slot 64 formed therein. The slot is generally sized to receive the strap 58 (but smaller than the pin 62) with an enlarged end or cavity 66, sized to generally receive a pin at the end. The strap 58 is slid into the slot 64 until the second end reaches the enlarged cavity 66 and a pin inserted through the end of the strap and enlarged cavity to secure the strap to the lobe 56. Other means are known for securing a strap to another body, including, but not limited to, fasteners, clamps, etc., the use of which will not defeat the spirit of the invention. Because the biasing member 44 is generally extended when the top 10 is in the stowed position and the main frame member 16 is in a first position, the biasing member pulls the strap 58 towards the biasing member, thereby urging the lobe 56 to rotate.

The housing 40 may also have an opening 68 formed therein. The opening 68 permits the strap 58 to exit the interior cavity 42 of the housing 40 to engage the lobe 56. In the embodiment seen in FIG. 4, the opening 68 also permits more space for the lobe 56 to rotate.

As seen in FIG. 4, the lobe 56 also includes a boss 70. The boss 70 is sized to be received in a member of the frame, in this case, the main frame member 16. In the embodiment seen in FIG. 4, the main frame member 16 can be secured to the boss by bolts and nuts 52, but other means for attaching a frame member to a boss are known in the art, including, but not limited to welding, friction fitting, clamping, other fasteners, etc., the use of which would not defeat the spirit of the invention. Alternatively, the boss 70 could be configured to receive a frame member within it or another means of attachment.

The strap 58 is wound partly around the lobe 56 such that if tension is applied to the strap, the strap urges the torque hub to rotate. Torque is created by applying a tensile force to the strap 58 which acts on the lobe 56. The amount of torque is determined by the amount of tensile force applied multiplied by the distance from the periphery of the lobe 56 to the axis of rotation 72, e.g. a bracket.

The biasing member 44 is connected to the strap 58 and fixed a determined distance from the lobe 56 with the distance determined by $F=kX$ where F is tensile force, k is the spring constant, and X is the amount of distance stretched. The amount of stretch is determined by the radius of the lobe 56 and the amount of rotation. When the biasing member 44 is stretched, the recoil causes tension on the strap 58. Since the strap 58 is fixed to the periphery of the lobe 56, the tension causes torque. Since the lobe 56 is rotatably attached to the housing 40 and attached to the first end to the main frame member 16, the torque results in rotational force or a lifting action on the main frame member 16. Because the frame members are connected to one another by a canvas, rotation of the main frame member 16, will eventually cause or assist in causing the rotation of the other frame members.

Since gravity is always acting on the frame members, their natural tendency is to fold at their hinges into a more horizontal orientation, e.g. a collapsed or stowed position. This natural inclination of folding due to gravity is controlled by the offsetting torque of the assist mechanism 38 created by the biasing member 44 opposing the folding action. The resulting effect to the user is that the top 10 feels balanced, can be moved between the deployed and stowed positions with little force and/or will not fall or raise in an uncontrolled manner. By adjustment of spring tension, the assist mechanism 38 may lift the frame element or secondary frame member to a more vertical position. In this way, it is also possible to significantly reduce or eliminate the effort required to manually raise the top 10. For example, in one embodiment, the torque applied to the lobe 56 is not sufficient or just less than the torque required to rotate the main frame member 16 from a first position (e.g. a stowed position) to a second position (e.g. a radar position).

The biasing member 44 can be configured in a number of known configurations as desired for the application. In one embodiment, the biasing member 44 is configured such that when the biasing member is fully extended or in its first position, e.g. when the top is in the stowed position (FIG. 6), the weight of the top 10 will overcome the force exerted by the biasing member such that the top is not moved towards the radar and/or deployed position unintentionally. A small amount of additional force pulling the top 10 towards the radar and/or deployed position, for example, by a vehicle occupant, will cause the top to move towards the radar and/or deployed position. In this position, the biasing member is contracted or at a second length, which is shorter than the first length. The biasing member 44 can be configured so that the additional force is the amount applied by a fingertip or more or less as desired. Because the weight of the top 10 will overcome the force exerted by the biasing member 44, when the top is moved from the deployed position towards the stowed position, just a small amount of force can be used to allow the top to move to that position in a controlled manner without crashing.

Alternatively, the assist mechanism 38 could be designed to provide a slightly greater force than needed to move the top 10 and/or the top from the stowed position into the extended position such that only a small amount of additional force would be used, for example by a person, to stop or slow the articulation of the top. Such force would also allow the top 10 to be collapsed into the stowed position in a safe and controlled manner because only a small amount of additional force or effort is used to overcome the force of the top 10 and force it into the stowed position.

As mentioned above, the lobe 56 can be attached to the axle 54 off-center to permit a cam effect that can vary the rate of deployment. For example, as the lobe 56 is rotated from the radar position, the main frame member 16 is rotated slower. As the main frame member 16 gets closer to the radar position, it is rotated faster. The shape of the lobe 56 can also affect the speed at which the main frame member 16 is rotated.

The lobe 56 may also have a channel or guide 74 formed therein. A tab 76, for example, a bolt, extends between the pair of side plates 46 and through and at least partially within the channel 74 of the lobe 56. The ends of the channel 74 act as stoppers to prevent over rotation of the lobe and, thereby, the frame member to which it is connected. For example, when the top 10 is in the stowed position, as seen in FIG. 6, and the main frame member 16 is in the first position, the secondary frame member 26 is in the closed position and the tab 76 is located at the first end 78 of the channel 74. In this position, the tab 76 is prevented from further rotation in a first direction.

As the main frame member 16 is rotated towards the radar position, the channel 74 moves along the tab 76 and the tab 76 gets closer to the second end 80. When the top 10 is in the radar position, the main frame member 16 is in the second position (which is same position as the deployed position for the main frame member), as seen in FIG. 4, and the tab 76 is located at the second end 80 of the channel 74. In this position, the tab 76 is prevented from further rotation in a second direction. The channel not only limits the amount of rotation of the lobe 56 and the main frame member 16, but also acts as a guide during rotation.

Figure 5:
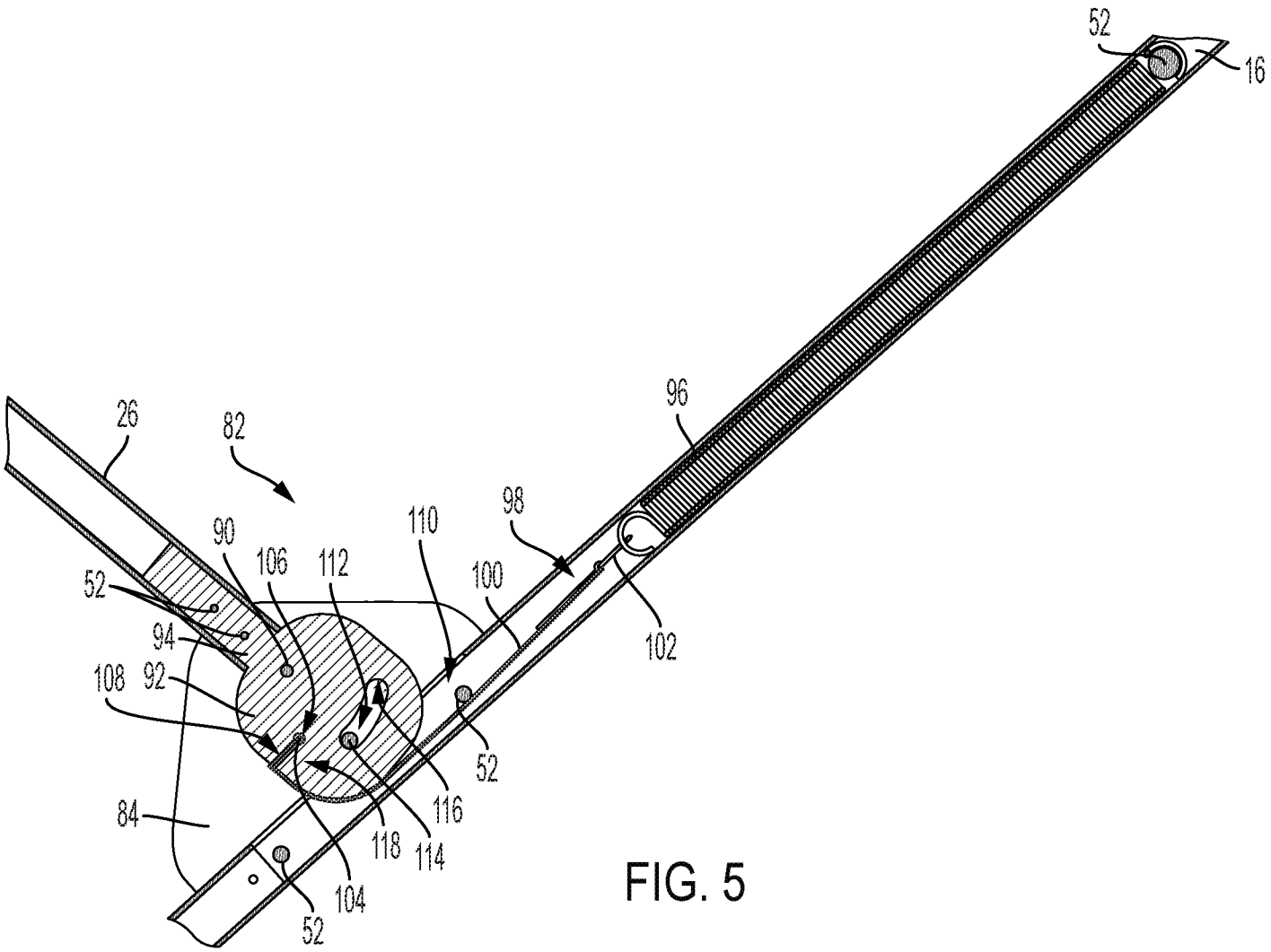
FIG. 5 is an enlarged cross-sectional elevation view of the assist mechanism of FIG. 1 when the articulated top is in the deployed position, according to one embodiment of the present disclosure.

In another embodiment, seen in FIG. 5, a secondary assist mechanism 82 can be used in addition or alternatively to the assist mechanism 38. The secondary assist mechanism 82 includes a pair of secondary side plates 84, one of which is attached to the exterior side 86 and another to the interior side 88 of the main frame member 16 such as by being bolted 52. A secondary axle 90 extends between the pair of secondary side plates 84 above the main frame member 16. A secondary lobe 92 is located between the pair of secondary side plates 84. A secondary axle 90 extends between the pair of secondary side plates 84 and through the secondary lobe 92 such that the secondary lobe rotates about the secondary axle and is rotatably attached to the main frame member 16 by the pair of secondary side plates. The secondary lobe 92 is fixedly attached to a first end of the secondary frame member 26, such as by a secondary boss 94 that is configured to be received by and attached to the secondary frame member 26, such as by bolts and nuts 52. In this embodiment, the secondary frame member 26 is rotatably attached to the main frame member 16 and configured to be moved between a closed or retracted position (FIG. 8) and an open or spread position (FIG. 2).

The secondary lobe 92 is attached to a second end of the secondary biasing member 96, for example, by a secondary strap 100. The secondary biasing member 96 can be at least partially located in an interior chamber 98 of the main frame member 16 and have a fixed first end attached to the main frame member. The secondary strap 100 can have a first end attached to the secondary biasing member 96 and a second end attached to the secondary lobe 92. For example, in one embodiment, the secondary strap 100 has a secondary ring 102 sown into a first end that attaches the strap to the second end of the secondary biasing member 96 and a second end with a loop sown therein to receive a secondary pin 104 when the second end of the secondary strap 100 is in the enlarged end or cavity 106 of the secondary slot 108 formed in the secondary lobe 92. The main frame member 16 may also have an opening 110 to permit the secondary strap 100 to exit the interior chamber 98 of the main frame member to engage the secondary lobe 92. In the embodiment seen in FIG. 5, the opening 110 also permits more space for the secondary lobe 92 to rotate.

The secondary biasing member 96 can be configured in a number of known configurations as desired for the application. In one embodiment, the secondary biasing member 96 is configured such that when the secondary biasing member is fully extended, e.g. when the top is in the stowed position (FIG. 6) or radar position (FIG. 8), the secondary lobe 92 and, thereby, the secondary frame member 26, are urged from the closed position towards the open position. The weight of the top 10, for example, the secondary frame member 26, auxiliary bow(s) 28, 30 and covering 12, will overcome the force exerted by the secondary biasing member such the secondary frame member 26 is not moved towards the open position unintentionally. A small amount of additional force pulling the top 10 towards the deployed position, for example, by a vehicle occupant, will cause the top to move towards the deployed position and the secondary frame member 26 to the open position (FIG. 2). The biasing member can be configured so that the additional force is the amount applied by a fingertip or more or less as desired. Because the weight of the top 10 will overcome the force exerted by the secondary biasing member 96, when the top is moved from the deployed position, in which the secondary biasing member is contracted, towards the radar position, just a small amount of force can be used to allow the top to move to that position in a controlled manner without crashing.

The secondary lobe 92 may also have a secondary channel 112. A secondary tab 114, for example, a bolt, extends between the pair of secondary side plates 84 and through the secondary channel 112 of the secondary lobe 92. The ends of the secondary channel 112 act as stoppers to prevent over rotation of the secondary lobe and, thereby, the frame member to which it is connected. For example, when the top 10 is in the radar position, as seen in FIG. 8, the secondary tab 114 is located at the first end 116 of the secondary channel 112. When the secondary frame member 26 is rotated towards the deployed position, the secondary channel 112 moves along the secondary tab 114 and the secondary tab gets closer to the second end 118. When the secondary frame member 26 is in the deployed position, as seen in FIG. 5, the secondary tab 114 is located at the second end 118 of the secondary channel 112. The secondary channel 112 not only limits the amount of rotation of the secondary lobe 92 and the secondary frame member 26, but also acts as a guide during rotation.

Auxiliary bows 28, 30 could also be connected to the main frame member 16 and/or and secondary frame member 26, respectively, using additional assist mechanisms that assist in movement of the top 10 between a collapsed and deployed position.

Figure 11:
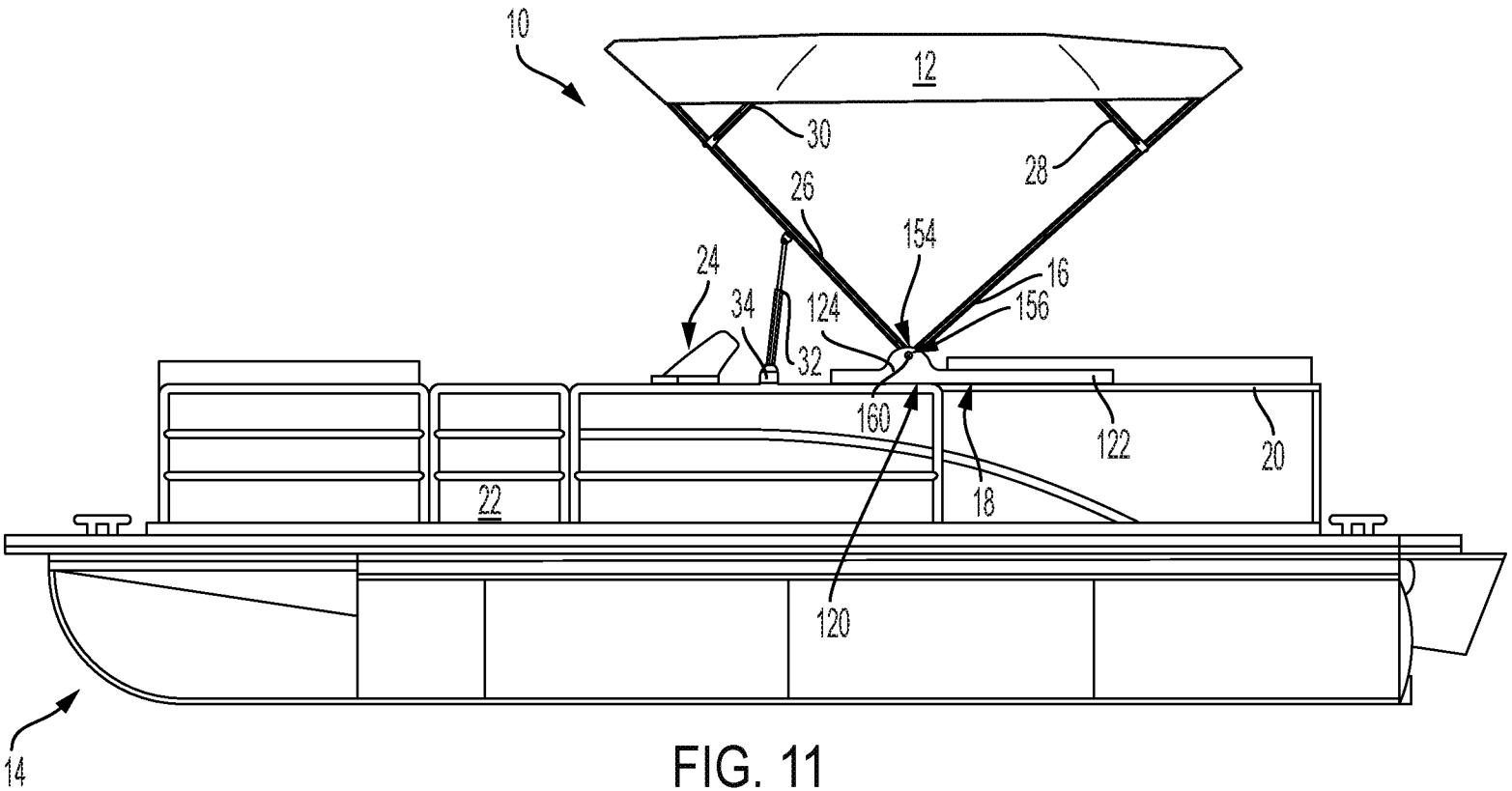
FIG. 11 is a side elevation view of a vehicle with an articulated top having an alternative embodiment of an assist mechanism.

In an alternative embodiment, the main frame member 16 and secondary frame member 26 are attached to the same assist mechanism. As seen in FIG. 11, the assist mechanism 120 includes body 122. The body 122 attaches to the vehicle 14, such as the rail 20 of the vehicle. The body can include a pivot bracket 124 with a rod 126 located therethrough, for example a bolt and nut. A hub 128 is located in the pivot bracket and the rod 126 extends through the hub to rotatably attach the hub to the body 122, as seen in FIGS. 12-14.

Figure 15:
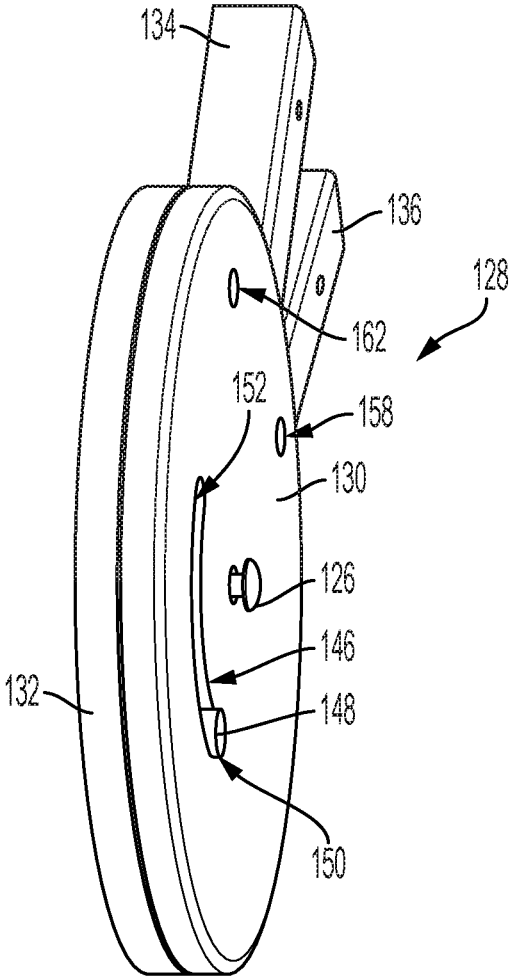
FIG. 15 is an enlarged perspective view of the hub of the assist mechanism in the radar position.

In one embodiment, as seen in FIG. 15, the hub 128 comprises a first portion 130 and a second portion 132 that can rotate independently of one another around the rod 126. The first portion 130 of the hub 128 has a first boss 134 configured to be received within and attached to, for example by bolts and nuts 52, the main frame member 16. The second portion 132 of the hub 128 has a second boss 136 configured to be received within and attached to, for example by bolts and nuts 52, the secondary frame member 26.

Figure 12:
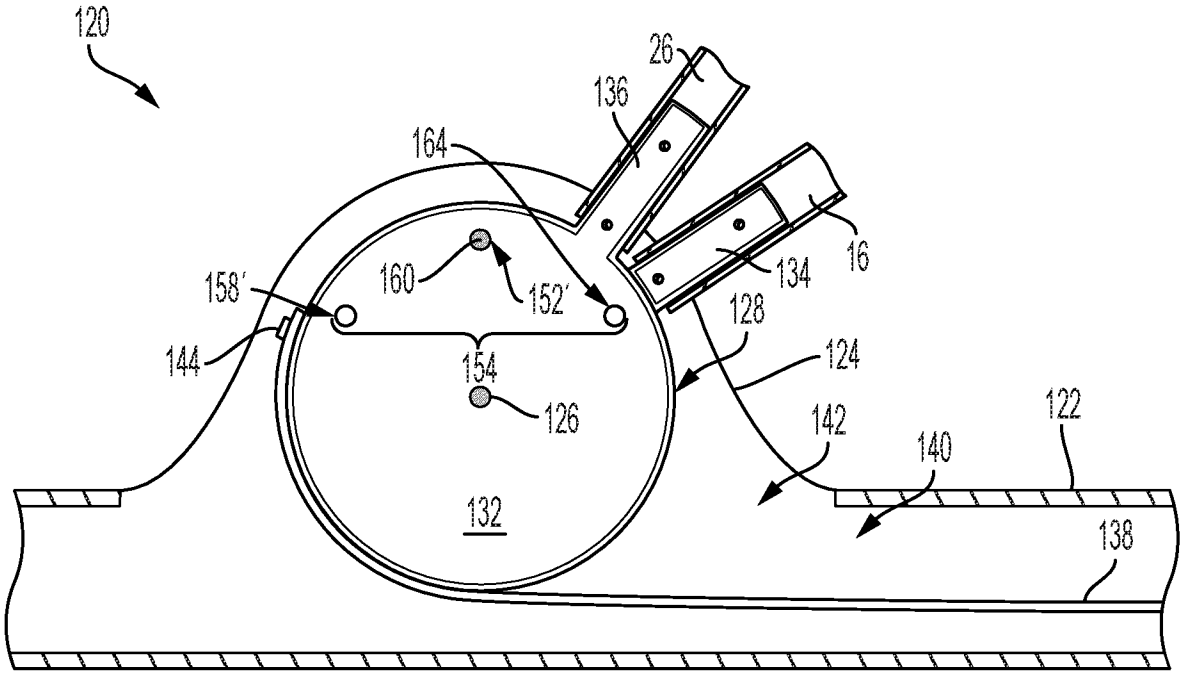
FIG. 12 is an enlarged elevation view of the assist mechanism of FIG. 11 with the exterior side of the body removed when the articulated top is in the radar position.
Figure 13:
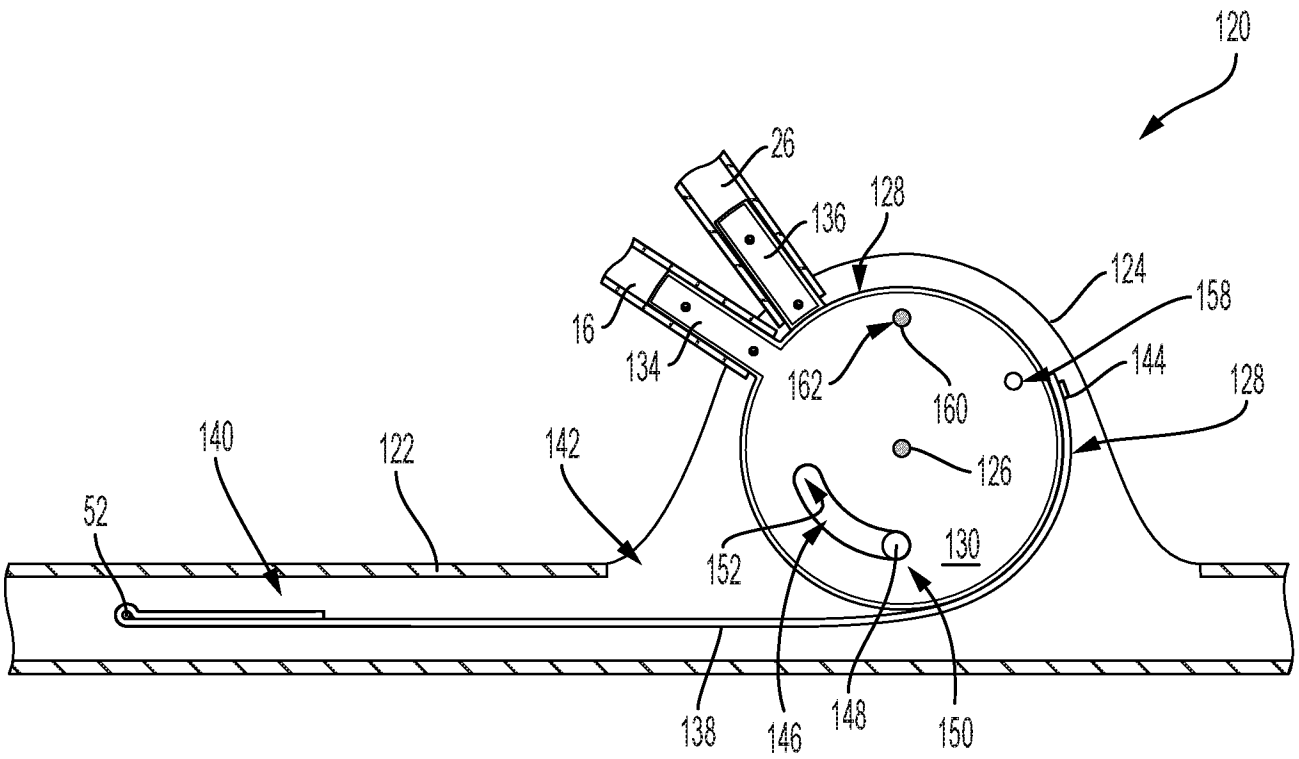
FIG. 13 is an enlarged elevation view of the other side of the assist mechanism of FIG. 12 with the interior side of the body removed when the articulated top is in the radar position.
Figure 14:
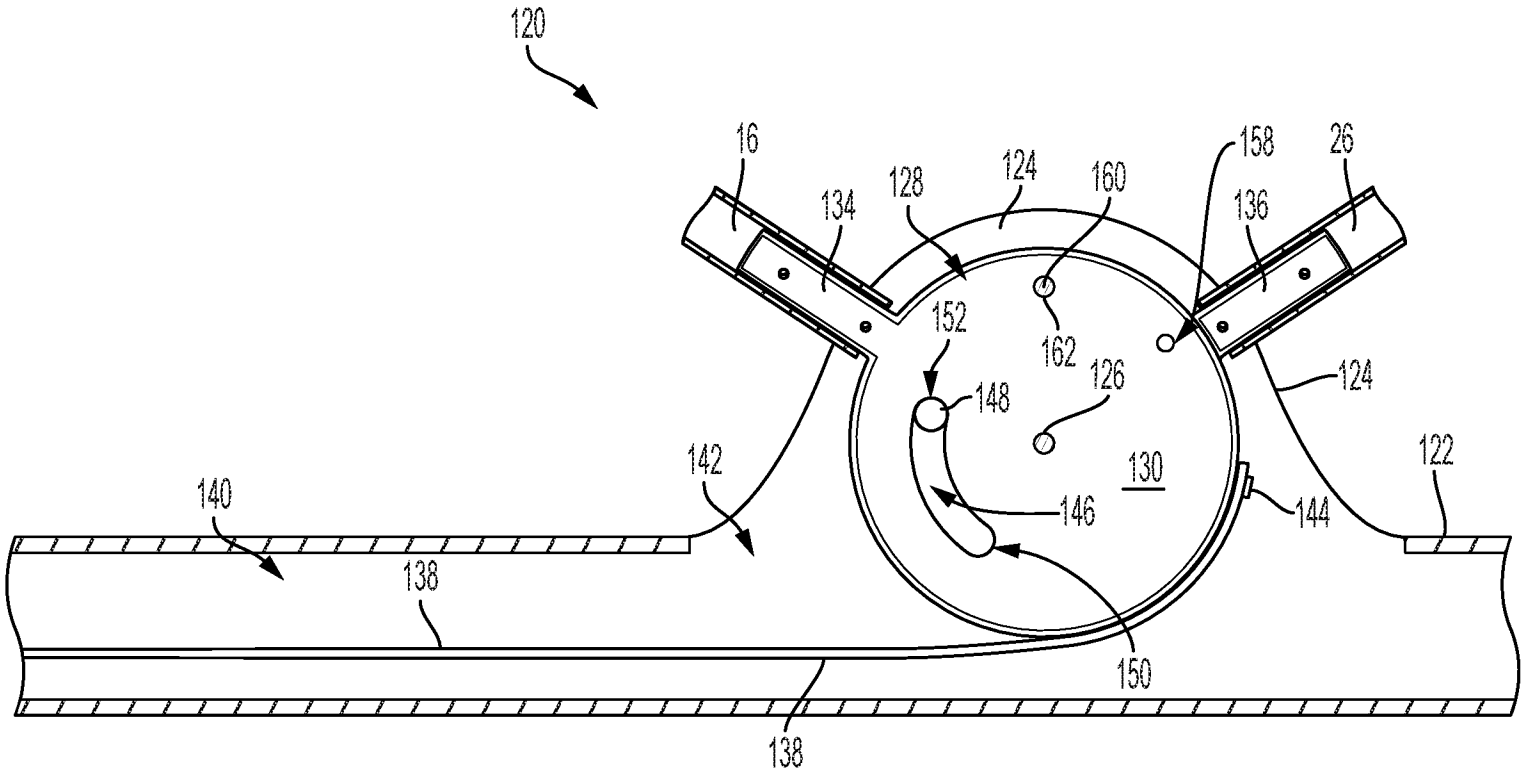
FIG. 14 is an enlarged elevation view of the assist mechanism of FIG. 13 with the interior side of the body removed when the articulated top is in the deployed position.

As seen in FIGS. 12-14, the body 122 can include a biasing member 138, such as an elastic material, with a first end secured in a compartment 140 of the body, such as by a bolt and nut 52. The biasing member 138 can be at least partially located in the compartment 140 and extends though an opening 142 formed in the body 122 to attach to the first portion 130 of the hub, such as by a fastener 144. In one embodiment, the biasing member 138 is configured such that when the biasing member is fully extended, e.g. when the top is in the stowed position (FIG. 6), the weight of the top will overcome the force exerted by the biasing member such that the top is not moved towards the deployed position unintentionally. A small amount of additional force pulling the top 10 towards the radar or deployed positions, for example, by a vehicle occupant, will cause the top to move towards the radar or deployed positions in a controlled manner.

For example, when the top 10 is in the stowed position (FIG. 6), the first portion 130 and second portion 132 are in the first position and the biasing member 138 urges the first portion 130 towards a second position. In this position, the end of the main frame member 16 attached to the first portion 130 is adjacent the end of the secondary frame member 26 attached to the second portion 132. When the top 10 is in the radar position (FIG. 8), the first portion 130 and second portion 132 are in the second position, e.g. the radar position (FIG. 8). In this position, the end of the main frame member 16 attached to the first portion 130 is adjacent the end of the secondary frame member 26 attached to the second portion 132. When the top 10 is in the deployed position (FIG. 2), the first portion 130 is in the second position and second portion 132 is in the third position. In this position, the end of the main frame member 16 attached to the first portion 130 is remote from the end of the secondary frame member 26 attached to the second portion 132.

As seen in FIG. 13, the first portion 130 includes a channel or guide 146. The second portion 132 includes a post 148 that extends at least partially through the channel 146. When the top 10 is in the stowed position, and the first portion is in the first position, the post 148 is located at a first end 150 of the channel 146. As the main frame member 16 is raised to the radar position, the first portion 130 of the hub 128 will rotate. As the first portion 130 rotates, the channel 146 rotates. Because the post is at the end of first end 150 of the channel 146, the first end will contact and force the post 148 and, thereby, the second portion 132 and secondary frame member 26 connected thereto to rotate. When the top 10 is in the radar position, the secondary frame member 26 can be moved towards the third position. Because the first portion 130 of the hub 128 is not rotating, the post 148 can move within the channel 146 to the second position 152, and the secondary frame member 26 can be moved to the third position (FIG. 14). When the top 10 is in the deployed position, the post 148 will be located at the second end 152 of the channel 146. Alternatively or additionally, the secondary frame member 26 could be rotatably or pivotally attached to the main frame member 16 by an assist mechanism.

The assist mechanism may also have a locking mechanism to prevent the hub from inadvertent rotation. In one embodiment, the locking mechanism 154 includes a spring pin 160 that engages when the hub 128 is rotated to a predetermined position. For example, both sides of the pivot bracket 124 have a hole 156 (one of which is seen in FIG. 11). When the top 10 is in the down position the holes 156 will be lined up with a hole 158 in the first portion 130 (FIG. 13) and a hole 158' in the second portion 132 (FIG. 12). A spring pin 160 can be inserted into the holes 156, 158, 158' to hold the top 10 in the stowed position. Similar holes 162, 162' can be located in the first portion 130 and the second portion 132, respectively, for when the top 10 is in the radar position and hole 164 in the second portion 132 (which lines up with hole 162 in the first portion 130 because the main frame member 16 does not move once it reaches the radar position) for when the top is in the deployed position. Although a spring pin 160 is shown, a number of mechanical holding means are known in the art, for example spring pin, detent pin, detent ball, threaded knob, cotter pin, ball detent pin, clamp or other mechanical holding means, the use of which would not defeat the spirit of the invention.

In the embodiment shown above, the frame members such as the main frame member 16, secondary frame member 26 and auxiliary frame members 28, 30 are depicted as a bow, e.g. a structural element having a port leg portion and a starboard leg portion connected by a generally curved middle portion. In one embodiment, an assist mechanism 38 and/or secondary assist mechanism 82, are located on each side of the top, for example a port side assist mechanism 38 and a port side secondary assist mechanism 82 on the port side and attached to the port leg portions or ends of the frame members and a starboard assist mechanism 38' and secondary assist mechanism 82' on the starboard side attached to the starboard leg portions or ends seen in FIG. 1. However, other configurations could be used without defeating the spirit of the invention.

Although the articulated top assist mechanism has been herein described in what is perceived to be the most practical and preferred embodiments, it is to be understood that it is not intended to be limited to the specific embodiments set forth above. For example, although the articulated top assist mechanism is described as being used with a frame for a marine top, the articulated top assist mechanism could be used in a variety of applications including different collapsible structures. Rather, it is recognized that modifications may be made by one of skill in the art of the invention without departing from the spirit or intent of the invention and, therefore, the invention is to be taken as including all reasonable equivalents to the subject matter of the appended claims and the description of the invention herein. Further, although certain advantages of different embodiments and disadvantages of certain prior art are described, no single claim must realize every or any benefit or overcome every or any disadvantage.

What is claimed is:

1. An articulated top for a marine vehicle, the articulated top comprising:

a covering;

an assist mechanism further comprising:

a housing configured to attach the articulated top to the marine vehicle;

a lobe rotatably attached to the housing; and a biasing member having a first end attached to the housing and a second end fixedly attached to the lobe; and a main bow attached to the covering, the main bow having a first end attached to the lobe;

wherein the main bow is configured to be moved at least between a first position in which the biasing member is extended and a second position in which the biasing member is contracted; and wherein when the main bow is in the first position, the biasing member urges the main bow towards the second position.

2. The articulated top of claim 1, wherein the biasing member urges the main bow towards the second position by applying a torque to the lobe and wherein the torque is not sufficient to rotate the main bow to the second position.

3. The articulated top of claim 2, wherein when the articulated top is in a stowed position, the main bow is in the first position and when the articulated top is in a radar position, the main bow is in the second position.

4. The articulated top of claim 1, further comprising a second assist mechanism, the second assist mechanism further comprising:

a second housing configured to attach the articulated top to the marine vehicle;

a second lobe rotatably attached to the second housing; and a second biasing member having a first end attached to the second housing and a second end attached to the second lobe;

wherein the main bow has a second end attached to the second lobe; and wherein the assist mechanism is configured to be located on a first side of the marine vehicle and the second assist mechanism is configured to be located on a second side of the marine vehicle.

5. The articulated top of claim 1, wherein the biasing member is located at least partially within the housing.

6. The articulated top of claim 1, wherein the lobe has a channel formed therein and the housing has a tab located at least partially within the channel; and wherein when the lobe rotates, the channel moves along the tab.

7. The articulated top of claim 6, wherein the channel has a first end and a second end and wherein when the tab reaches the first end, the main bow is prevented from further rotation in a first direction and when the tab reaches the second end, the main bow is prevented from further rotation in a second direction.

8. The articulated top of claim 1, further comprising:

a secondary lobe pivotally attached to the main bow; and a secondary biasing member having a first end attached to the main bow and a second end attached to the secondary lobe;

a secondary bow attached to the covering, the secondary bow having a first end attached to the secondary lobe;

wherein the secondary bow is configured to be moved at least between a retracted position in which the secondary biasing member is extended and a spread position in which the secondary biasing member is contracted; and wherein when the secondary bow is in the retracted position, the secondary biasing member urges the secondary bow towards the spread position.

9. The articulated top of claim 8, wherein when the articulated top is in a radar position, the main bow is in the second position and the secondary bow is in the retracted position and when the articulated top is in a deployed position, the main bow is the second position and the secondary bow is in the spread position.

10. The articulated top of claim 8, wherein when the main bow is the first position and the secondary bow is in the retracted position, the main bow is generally parallel to the secondary bow.

11. The articulated top of claim 10, wherein when the main bow is the second position and the secondary bow is in the retracted position, the main bow is generally parallel to the secondary bow.

12. The articulated top of claim 11, wherein when the main bow is the second position and the secondary bow is in the spread position, the main bow is generally perpendicular to the secondary bow.

13. A frame for a canopy comprising:

a first rotatable frame member; and a second frame member rotatably attached to the first rotatable frame member by an assist mechanism, the assist mechanism further comprising:

a core rotatably attached to the first rotatable frame member and fixedly attached to the second frame member; and a biasing member having a fixed first end and a second end attached to the core;

wherein the second frame member is configured to be moved at least between a closed position in which the biasing member is a first length and an open position in which the biasing member is a second length;

wherein the first length is longer than the second length; and wherein when the second frame member is in the closed position, the biasing member urges the second frame member towards the open position.

14. The frame of claim 13, wherein the biasing member is at least partially located in an interior chamber of the first rotatable frame member and the fixed first end is attached to the first rotatable frame member.

15. The frame of claim 13, further comprising a pair of plates attached to the first rotatable frame member; and wherein the core is located between the pair of plates and is rotatably attached to first rotatable frame member by the pair of plates.

16. The frame of claim 15, further comprising an axle extending between the pair of plates and through the core; and wherein the core rotates about the axle.

17. The frame of claim 13, wherein the core further comprises a boss and wherein the second frame member is attached to the core by receiving the boss.

18. The frame of claim 13, wherein the biasing member is attached to the core by a strap; wherein a first end of the strap is attached to the biasing member and a second end of the strap is attached to the core.

19. The frame of claim 18, wherein the core has a slot formed therein and the slot has an enlarged end;

wherein the second end of the strap has a loop;

wherein the strap is located at least partially within the slot and the loop is located in the enlarged end;

wherein a pin is located within the loop; and wherein when the pin is in the loop and the loop is in the enlarged end, the strap is attached to the core.

20. A top comprising:

a body;

a hub pivotally attached to the body, the hub having a first portion and a second portion;

a biasing member located at least partially within the body and attached at one end to the first portion;

a first frame member attached to a cover material and having an end fixedly attached to the first portion; and a second frame member attached to the cover material and having an end fixedly attached to the second portion;

wherein the biasing member is configured to urge the first portion from a first position to a second position.

21. The top of claim 20, wherein the hub is configured such that when the first portion is rotated from the first position to the second position, the second portion is rotated from the first position to the second position.

22. The top of claim 21, wherein the first portion has a guide formed therein and the second portion has a post extending at least partially into the guide;

wherein when the first portion is in the first position, the post is at a first end of the guide; and wherein when the first portion is moved from the first position to the second position, the first end of the guide contacts the post to rotate the second portion from the first position to the second position.

23. The top of claim 22, wherein when the second portion is moved from the second position to a third position, the post moves along the guide away from the first end.

24. The top of claim 23, wherein when the first portion and second portion are in the first position, the end of the first frame member is adjacent the end of the second frame member.

25. The top of claim 24, wherein when the first portion and second portion are in the second position, the end of the first frame member is adjacent the end of the second frame member.

26. The top of claim 25, wherein when the first portion is in the second position, and the second portion is in the third position, the end of the first frame member is remote from the end of the second frame member.

27. The articulated top of claim 1, wherein the second end of the biasing member is fixedly attached to the lobe by a strap and wherein the first end of the strap is attached to the second end of the biasing member and the second end of the strap is attached to the lobe.

28. The articulated top of claim 1, wherein the second end of the biasing member is fixedly attached to the lobe at a location of the lobe and wherein the second end of the biasing member is attached to the lobe at the location when the main bow is in the first position and second position.

29. The frame for a canopy of claim 13, wherein the first rotatable frame member is configured to be attached to a cover material.

30. The top of claim 20 wherein the first portion is adjacent the second portion.

* * * * *